US005722812A

United States Patent [19]

Knox et al.

[11] Patent Number: 5,722,812

[45] Date of Patent: Mar. 3, 1998

[54] ABRASION RESISTANT CENTRIFUGAL PUMP

[75] Inventors: Dick L. Knox, Claremore; J. Tad Bohlen, Broken Arrow, both of Okla.

[73] Assignee: Baker Hughes Incorporated, Houston, Tex.

[21] Appl. No.: 785,715

[22] Filed: Jan. 17, 1997

Related U.S. Application Data

[63] Continuation of Ser. No. 667,020, Jun. 20, 1996, abandoned.

[51] Int. Cl.[6] ..... F04D 29/04; F04D 29/44; F04D 29/66

[52] U.S. Cl. ..... 415/199.1; 415/229; 415/901; 417/365; 417/423.12; 417/424.1

[58] Field of Search ..... 415/104, 199.1, 415/199.2, 199.3, 229, 901; 417/244, 365, 423.12, 424.1, 424.2

[56] References Cited

U.S. PATENT DOCUMENTS

| | | | |
|---|---|---|---|
| 1,798,787 | 3/1931 | Conant | 415/199.1 |
| 3,171,355 | 3/1965 | Harris et al. | 417/365 |
| 4,678,399 | 7/1987 | Vandevier et al. . | |
| 4,741,668 | 5/1988 | Bearden . | |
| 4,781,531 | 11/1988 | James . | |
| 4,838,758 | 6/1989 | Sheth . | |
| 4,872,808 | 10/1989 | Wilson . | |
| 5,033,937 | 7/1991 | Wilson . | |
| 5,160,240 | 11/1992 | Wilson . | |

OTHER PUBLICATIONS

Centrilift "San Handler" Abrasion Resistant Pumps Brochure, dated Jan. 23, 1991 as Plaintiff's Deposition Exhibit.

*Primary Examiner*—Christopher Verdier
*Attorney, Agent, or Firm*—James E. Bradley

[57] ABSTRACT

A centrifugal well pump has modules of pumping stages, each module having a separate thrust bearing. The thrust bearing for each module is supported by an uppermost diffuser of the module. A thrust runner rotates with the shaft and engages the stationary thrust bearing. A tension member engages the runner and extends downward through the stages. The tension member has a number of upward facing load shoulders, one for each impeller within the module. Each of the load shoulders supports the hub of one of the impellers. Downthrust on each impeller transfers through the load shoulder to the tension member, and from there to the thrust runner.

38 Claims, 4 Drawing Sheets

ABRASION RESISTANT CENTRIFUGAL PUMP

This a continuation of application Ser. No. 08/667,020, filed Jun. 20, 1996, now abandoned.

BACKGROUND OF THE INVENTION

1. Field of the invention

This invention relates in general to submersible centrifugal pumps, and in particular to wear resistant components located in the pump stages for reducing erosion and abrasion.

2. Description of the Prior Art

Centrifugal pumps of the type concerned herein are submersible well pumps normally used for pumping high volumes of fluid, such as oil wells which produce large quantities of water, or high volume water wells. The pump assembly has a downhole electrical motor coupled to a centrifugal pump. The pump has numerous stages of diffusers and impellers for pumping fluid to the surface from the well. Normally, the impellers and diffusers are made from a cast alloy. The impellers rotate within the diffusers, and the mating sliding surfaces are machined smooth to reduce wear and to provide close clearances for sealing. Elastomeric thrust washers may be located between the impellers and diffusers to avoid metal-to-metal contact in the direction of downward and upward thrust.

If the fluid being pumped contains a significant amount of entrained sand, the abrasive particles will abrade and/or erode the pump impellers and diffusers, shortening the life of the pump. Pumps are available which have features to reduce wear due to sand. These features include utilizing wear resistant bearings of harder material than the impeller and diffuser, such as tungsten carbide. For extremely severe conditions, hard bearing surfaces can be placed within each stage. Hard bearing components, however, are considerably more expensive than conventional pump stage components, and may not be needed in each stage for less severe conditions.

In one configuration, hard bearing components are utilized only every few stages, such as every two to ten stages. One type of pump being marketed utilizes hard bearing components for reducing radial wear. In this pump, the impellers are fixed to the shaft and unable to move axially with the shaft. The downthrust on each impeller transfers directly to the shaft, rather than to a diffuser. The downthrust on the shaft is handled by a large thrust bearing located below the pump in a separate seal section. In another type of pump, the impellers are each free to float or move short distances axially relative to the shaft. A stationary thrust bearing and a rotating runner are placed every few stages. The hubs of the impellers abut each other to transfer downthrust to the thrust bearing located at the base of each module within the pump.

SUMMARY OF THE INVENTION

In this invention, the pump is of a floating impeller type wherein the impellers are free to move axially short distances relative to the shaft. The pump is divided into modules, each module having a selected number of stages, typically between two and ten. A stationary thrust bearing is supported at the upper end of each module. A thrust runner rotates with the shaft and engages the thrust bearing. A tension member has an upper end in engagement with the runner and extends downward through the stages of the module. Each of the tension members has a number of upward facing load shoulders spaced along its length, one for each of the impellers within the module. Each load shoulder supports the hub of one of the impellers. Downthrust on each of the impellers transfers to the tension members and through the tension member back up to the thrust runner and thrust bearing.

DETAILED DESCRIPTION OF THE INVENTION

Figure 1:
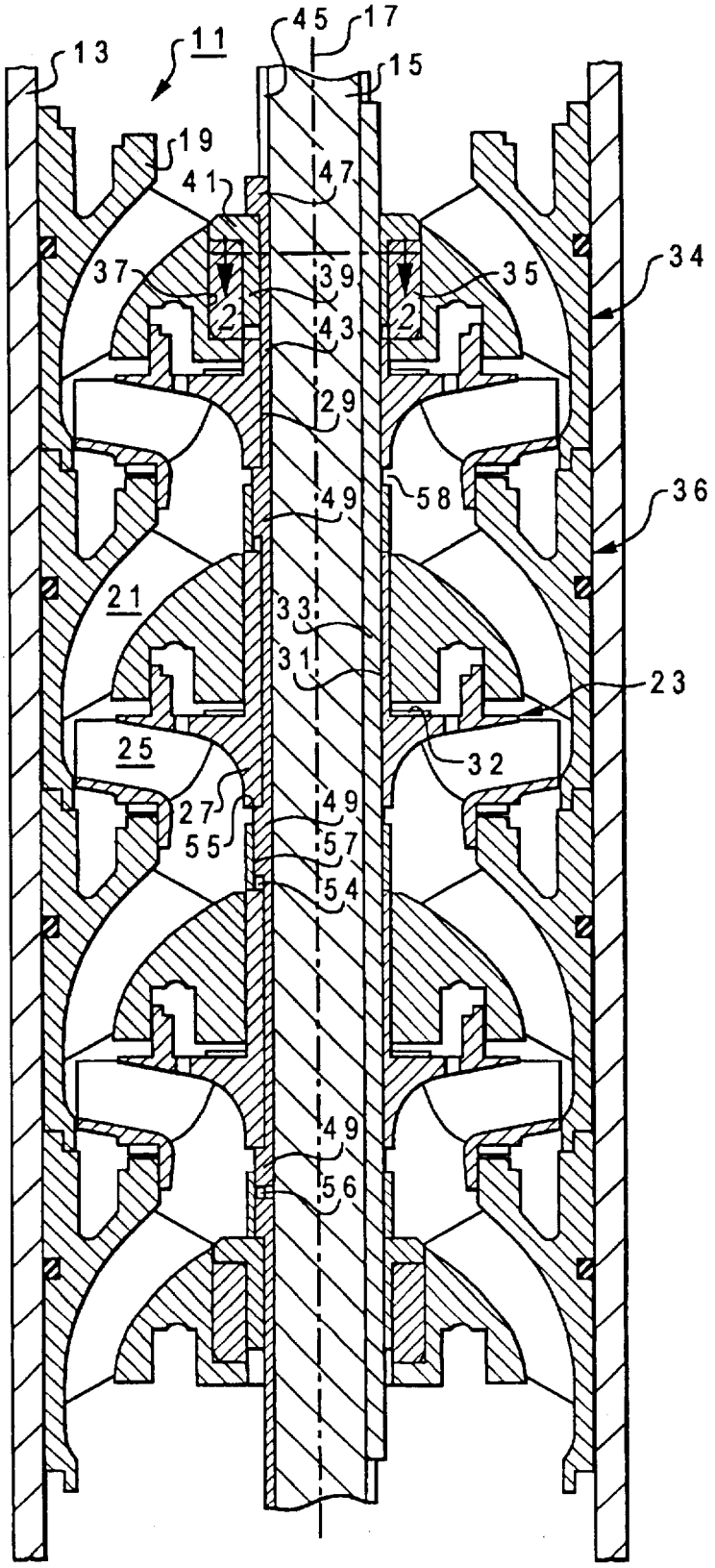
FIG. 1 is a vertical sectional view of a portion of a submersible pump constructed in accordance with a first embodiment of this invention.
Figure 2:
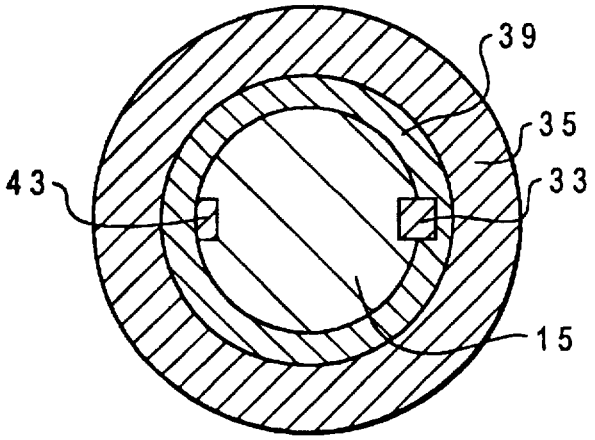
FIG. 2 is a sectional view of a portion of the pump of FIG. 1, taken along the line 2—2 of FIG. 1.

Referring to FIG. 1, pump 11 has a tubular housing 13. A shaft 15 extends through housing 13 along a longitudinal axis 17. Shaft 15 is driven by an electrical motor (not shown). Shaft 15 drives a plurality of pumping stages, which in some instances may be several hundred.

Each pumping stage includes a diffuser 19. Diffuser 19 has a plurality of passages 21 which extend from a radial outward position to a radial inward position, delivering the fluid both upward and inward. Diffusers 19 are stacked on one another and stationarily mounted in housing 13. An impeller 23 is associated with each diffuser 19. Each impeller 23 has a plurality of passages 25, each having a discharge on a radial outward periphery of the impeller and an intake at an inner periphery.

Each impeller 23 has a central hub 27 which extends into the central bore of one of the diffusers 19. Each hub 27 has a bore 29 through which shaft 15 extends. A longitudinal key way 31 is formed in one side of shaft 15 and also in one side of bore 29. A rectangular key 33 locates within keyway 31 for causing shaft 15 to rotate impellers 23. Key 33 preferably extends substantially the length of pump 11. Impellers 23 are not axially fixed to shaft 15, rather they are free to slide distances upward and downward relative to shaft 15. An upthrust pad 32 on each impeller will contact its mating diffuser 19 under sufficient upthrust.

Pump 11 has at least one module within it which has a number of pumping stages. Preferably, pump 11 will be divided entirely into modules, each having between two and ten stages. In FIG. 1, each module has three pumping stages. The uppermost or thrust bearing stage 34 within the module handles the downthrust for the two dependent stages 36 within the module. This is handled by a stationary thrust bearing 35 which is mounted to the uppermost diffuser 19. In this embodiment, stationary thrust bearing 35 is a cylindrical member which is securely fastened within a counterbore 37 formed in diffuser 19. The upper edge or rim of thrust bearing 35 serves as a bearing surface for receiving downthrust.

A thrust runner 39 rotates with shaft 15 and engages the thrust bearing. Thrust runner 39 in this embodiment is also a cylindrical member whose outer diameter is closely received within the inner diameter of stationary thrust bearing 35. Runner 39 has a flange 41 at the upper end which extends radially outward and engages the rim of thrust bearing 35 to transmit downthrust to stationary thrust bearing 35. The bore of runner 39 closely receives shaft 15. Key 33 extends also through runner 39, which has a mating keyway portion. Key 33 causes runner 39 to rotate with shaft 15 and allows runner 39 to move axially slight distances relative to shaft 15. Thrust bearing 35 and runner 39 are of a hard material, being harder and more wear resistant than the material of diffuser 19 and impeller 23. The preferred material is tungsten carbide.

A tension rod 43 extends through the bore of runner 39 and also bores 29 of impellers 23. Tension rod 43 locates within a longitudinal groove 45 formed in one side of shaft 15. Groove 45 is located 180 degrees from keyway 31 for balancing. In the embodiment shown there is no mating groove to groove 45 contained within the bore of runner 39 or bores 29 of impellers 23. Tension rod 43 thus does not transmit rotary motion to runner 39 and impellers 23, as this is handled by key 33. Tension rod 43 has an upper tab 47 which extends over runner flange 41. Upper tab 47 has a downward facing shoulder that bears downward on flange 41.

Figure 3:
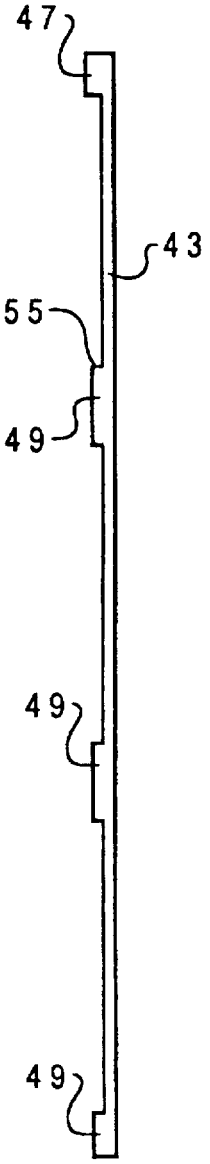
FIG. 3 is a side view of a tension rod employed with the pump of FIG. 1.
Figure 5:
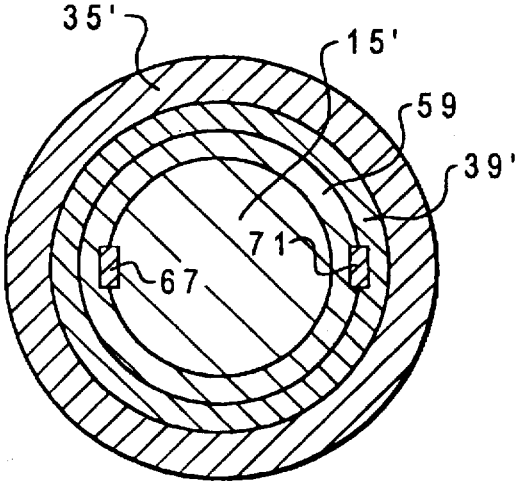
FIG. 5 is a sectional view of a portion of the pump of FIG. 4, taken along the line 5—5 of FIG. 4.
Figure 6:
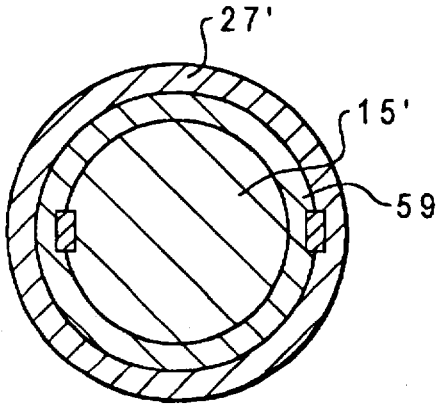
FIG. 6 is a sectional view of a portion of the pump of FIG. 4, taken along the line 6—6 of FIG. 4.
Figure 4:
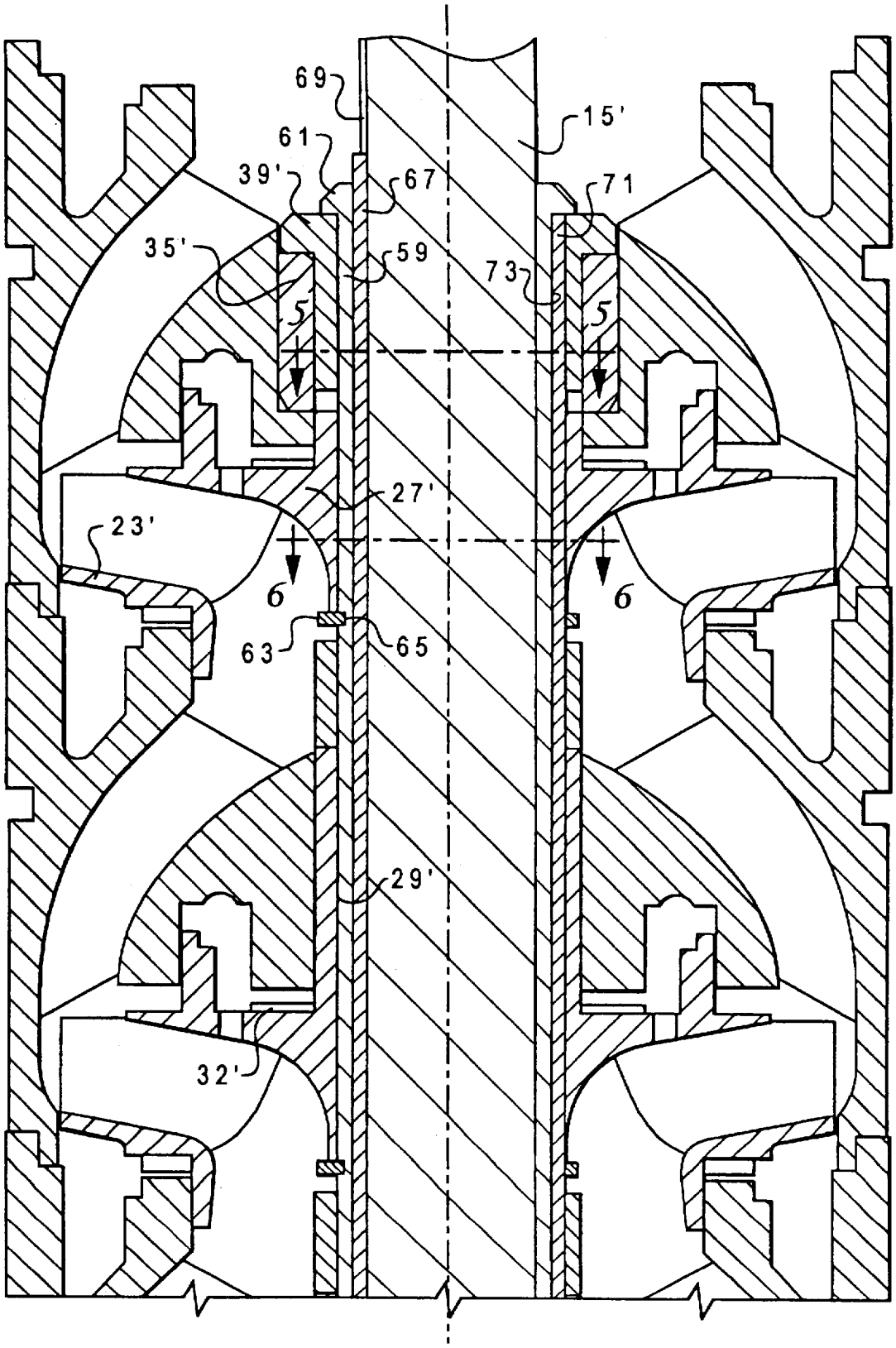
FIG. 4 is a sectional view of a portion of a submersible pump constructed in accordance with a second embodiment of this invention.
Figure 7:
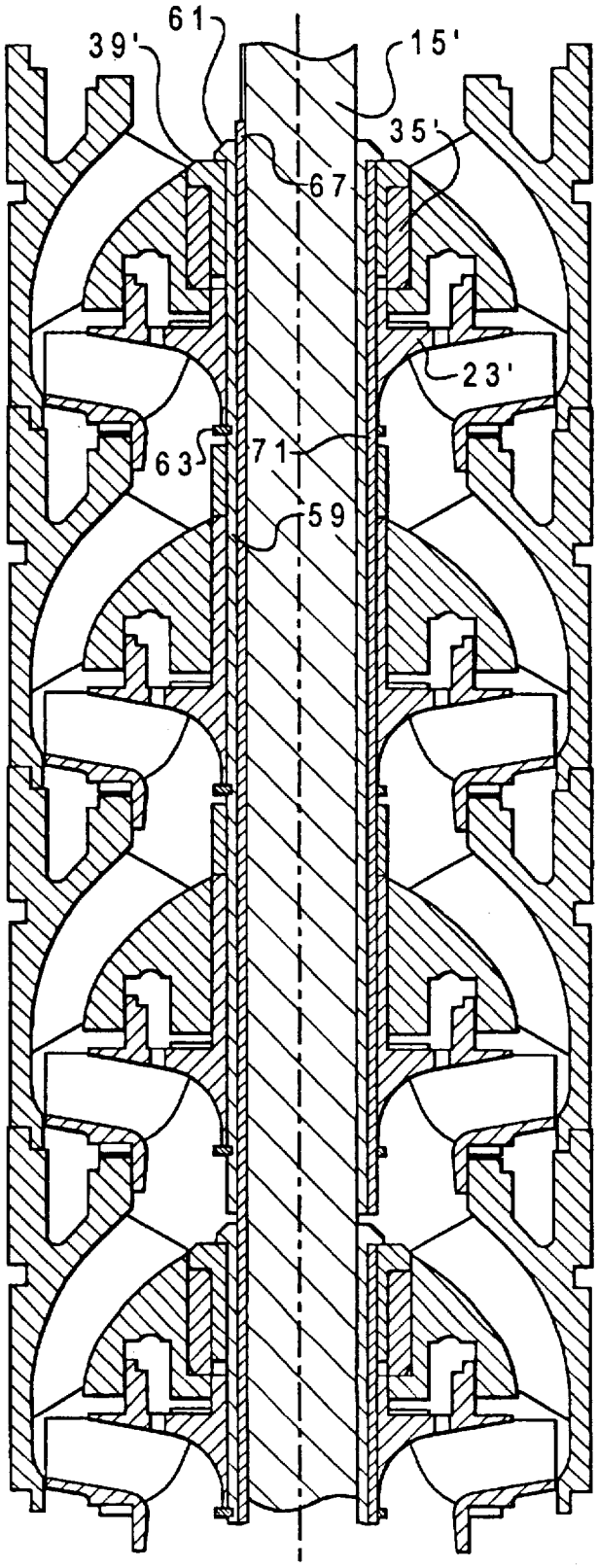
FIG. 7 is a sectional view of portions of the pump of FIG. 4, shown in a smaller scale.

As shown also in FIG. 3, tension rod 43 has three tabs 49 spaced along the length below tab 47, one of them for each of the impellers 23 in the module. Each tab 49 has an upward facing shoulder 55 that engages and supports the lower end of each hub 27 against downward movement. Each tab 49 protrudes radially outward from shaft 15 and separates the lower end of hub 27 of each impeller 23 from the upper end of hub 27 of the next lower impeller 23. The axial length of each tab 49 is less than the distance between the upper and lower ends of adjacent hubs 27, resulting in an axial clearance 54. The axial distance between adjacent tabs 49 is longer than the length of each hub 27 by the amount of each clearance 54. Unlike key 33, tension rod 43 has a length only proportional to the length of the desired module. A clearance 56 exists between the lowermost tab 49 and upper tab 47 of the next lower tension rod 43.

A sleeve 57 extends around shaft 15 between each of the hubs 27, enclosing clearance 54 and a portion of one of the tabs 49. Sleeve 57 has a length approximately the same as each tabs 49, resulting in a clearance 58. Sleeve 57 provides a smooth transitional surface between hubs 27 for fluid flow.

During assembly of the first embodiment, each impeller is placed within one of the diffusers and the diffusers stacked on one another to make up a module prior to installation in housing 13. Then tension rod 47 is positioned in the bores 29 of the impellers 23. Key 33 is positioned in keyway 31. Then the assembled module is pushed over shaft 15 and into housing 13, with tension rod 47 sliding into groove 45. The next module is then assembled in the same manner and inserted over shaft 15 into housing 13.

In the operation of the first embodiment, as shaft 15 rotates, impellers 23, runner 39 and tension rod 43 rotate. The pump stages will pump fluid upward through pump 11, resulting in a downthrust on each of the impellers 23. The downthrust of each impeller 23 is transferred to the upward facing shoulder 55 of each of the tabs 49. This creates a downward force on tension rod 43. The downward force is transferred from the downward facing shoulder of upper tab 47 to flange 41 of runner 39. Runner 39 engages the upper surface of thrust bearing 35 in sliding contact, and transfers the downthrust to thrust bearing 35. Thrust bearing 35 in turn transfers the thrust to housing 13 via the diffusers 19.

Clearance 56 prevents one tension rod 43 from transferring downthrust to the next lower tension rod 43. Clearances 54 prevent any transfer of downthrust from a hub 27 of one impeller 23 to the hub 27 of the next lower impeller 23 within a module. Under certain circumstances, upward thrust may occur, tending to cause impellers 23 to move upward relative to shaft 15 and diffusers 19. If this occurs, the upthrust pad 32 of each impeller 23 will contact its mating surface in diffuser 19 to transfer the upthrust from each impeller 23 to its diffuser 19. The dimensions of clearances 54 and 58 are smaller than the distance from each upthrust pad 32 to its mating surface in diffuser 19, so that upthrust will not be transmitted from one hub 27 to the next upward hub 27. During upthrust, tension rod 43 is free to move upward also, and if so, upper tab 47 will lift above the upper surface of thrust runner 39. Upthrust cannot be transmitted to stationary bearing 35.

Referring to FIGS. 4–7, elements that are common to FIG. 1 will be shown with a prime signal. In the second embodiment, the same principles apply. However, rather than a rectangular rod such as tension rod 43, a cylindrical tension sleeve 59 is employed. Tension sleeve 59 extends through the bore of runner 39', and the bores 2' of hubs 27'. Tension sleeve 59 has a collar 61 on its upper end that extends radially outward. Collar 61 has a downward facing shoulder that bears against thrust runner 39'. Rather than tabs 47 as in FIG. 1, a plurality of axially spaced apart snap rings 63 are employed to provide support for each impeller 23'. Each snap ring 63 has an upward facing shoulder which provides support to the lower end of one of the hubs 27'. Each snap ring 63 is located within a circumferential groove 65 formed on the exterior of tension sleeve 59.

Tension sleeve 59 rotates with shaft 15'. An inner key 67 locates within an inner keyway 69 that is formed both on the exterior of shaft 15' and bore of tension sleeve 59. Inner key 67 extends substantially throughout the length of the pump, and is not limited to the length of the module.

An outer key 71 engages an outer keyway 73 formed on the exterior of tension sleeve 59 and the interior of thrust runner 39' and bores 29' of hubs 27'. Outer keyway 73 is located 180 degrees from inner keyway 69 for balancing. Outer keyway 73 causes the rotary motion imparted to tension sleeve 59 to rotate thrust runner 39' and impellers 23'. In the embodiment shown, outer key 71 has a length proportional to only one module.

To assemble the second embodiment, a module will be made up exterior of the housing (not shown). The assembler will slide the uppermost diffuser 19', with runner 39', from the lower end of tension sleeve 59 up into contact with flange 61. He slides the uppermost impeller 23' from the lower end of tension sleeve 59 into contact with the uppermost diffuser 19', then installs the uppermost snap ring 63. He assembles the other stages in a similar manner to make up the module. Inner key 67 will be positioned in shaft keyway 69. The assembler will install outer key 71 and insert the module over shaft 15' into the housing (not shown).

During operation, as shaft 15' rotates, it rotates tension sleeve 59, which in turn causes rotation of thrust runner 39' and impellers 23'. Downthrust of each impeller 23' is transferred to each snap ring 63. This downthrust is transmitted by collar 61 to thrust runner 39'. Thrust runner 39' engages stationary bearing 35', which transfers downthrust of the impellers 23' in the module to the diffusers 19'. Any upthrust is handled by the upthrust pads 32' engaging mating surfaces in the diffusers 19'.

The invention has significant advantages. Downthrust of each impeller transfers directly to the tension member and from there to a thrust runner independently of any of the other stages within the module.

While the invention has been shown in only two of its forms, it should be apparent to those skilled in the art that it is not so limited, but is susceptible to various changes without departing from the scope of the invention. For example, the pump shown in both embodiments is a mixed flow type. The invention is equally applicable to a radial flow type pump. In that instance, the stationary thrust bearing may comprise an upper surface formed on a necked portion of the diffuser, rather than a separate sleeve located within a counterbore in the diffuser.

We claim:

1. In a centrifugal pump having a housing, a driven shaft extending along a longitudinal axis, a plurality of pumping stages, each stage having a diffuser mounted stationarily in the housing and an impeller having a hub through which the shaft extends for rotating the impeller, the pump having at least one module containing a plurality of the stages and comprising in combination:

an upward facing stationary bearing surface supported by an uppermost diffuser of the module;

a runner which rotates with the shaft and has a downward facing bearing surface which engages the stationary bearing surface; and a tension member having an upper end in engagement with the runner and extending downward through the stages, the tension member having a plurality of upward facing load shoulders spaced along its length, each of the load shoulders supporting the hub of one of the impellers, whereby downthrust on each of the impellers transfers through one of the load shoulders to the tension member, and through the tension member to the runner and stationary bearing surface.

2. The pump according to claim 1 wherein the tension member comprises a rod which locates within a groove formed on one side of the shaft.

3. The pump according to claim 1 wherein the tension member comprises a sleeve which locates within an annular space between the shaft and the runner and between the shaft and the hubs.

4. The pump according to claim 1 wherein the upper end of the tension member comprises a downward facing shoulder which bears downward on the runner.

5. The pump according to claim 1 wherein the load shoulders extend radially outward from the tension member.

6. The pump according to claim 1, further comprising a clearance located between adjacent hubs of impellers within the module, the clearance allowing the impellers to move upward slightly relative to the shaft during upthrust.

7. The pump according to claim 1 wherein:

a key locates within a keyway formed between the hubs of the impellers and the shaft and the runner and the shaft to cause rotation of the impellers and the runner with the shaft; and the tension member comprises a rod which locates within a groove formed on a side of the shaft opposite the keyway.

8. The pump according to claim 1 wherein:

the stationary bearing surface is formed on a stationary member which has a cylindrical bore; and the runner has a cylindrical portion which is rotatably carried in the bore of the stationary member and an upper flange, the downward facing bearing surface of the runner being located on the flange.

9. In a centrifugal pump having a housing, a driven shaft extending along a longitudinal axis, a plurality of pumping stages, each stage having a diffuser mounted stationarily in the housing and an impeller having a hub through which the shaft extends for rotating the impeller, the improvement comprising in combination:

a stationary member on at least one of the diffusers, having an upward facing stationary bearing surface and a bore;

a runner having a cylindrical portion which is rotatably carried in the bore of the stationary member and an upper flange which has a lower surface which engages the stationary bearing surface;

key means for causing the runner and impellers to rotate with the shaft but allowing axial movement relative to the shaft; and a tension member having a downward facing shoulder on an upper end which engages the runner and extends downward through a selected number of the stages, the tension member having a plurality of upward facing load shoulders spaced along its length, each of the upward facing load shoulders extending radially outward between two of the hubs and supporting one of the hubs against downthrust, whereby downthrust on each of the impellers transfers to the tension member and through the tension member to the runner and stationary bearing surface.

10. The pump according to claim 9 wherein the tension member comprises a rod which locates within a groove formed on a side of the shaft.

11. The pump according to claim 9 wherein the tension member comprises a sleeve which surrounds the shaft and extends through the hubs of the selected number of stages.

12. In a centrifugal pump having a housing, a driven shaft extending along a longitudinal axis, a plurality of pumping stages, each stage having a diffuser mounted stationarily in the housing and an impeller having a hub through which the shaft extends for rotating the impeller, the pump having at least one module having a selected number of the stages and comprising in combination:

at least one stationary member on one of the diffusers and having an upward facing stationary bearing surface;

a runner having a bore which receives the shaft for rotation with the shaft and a lower surface which engages the stationary bearing surface;

a tension rod extending from the runner downward through the stages, the tension rod having a plurality of upward facing load shoulders spaced along its length, each of the upward facing load shoulders extending radially outward between two of the hubs and supporting one of the hubs against downthrust, whereby downthrust on each of the impellers transfers to the tension member and through the tension member to the runner and stationary bearing surface.

13. The pump according to claim 12, wherein the tension rod extends into the bore of the runner and has a downward facing shoulder that engages the runner.

14. The pump according to claim 12, wherein the tension rod is located within a longitudinal groove formed in the shaft.

15. The pump according to claim 12 further comprising:

a key located in a keyway on a side of the shaft opposite the tension rod for causing the runner and impellers to rotate with the shaft but allowing axial movement relative to the shaft.

16. In a centrifugal pump having a housing, a driven shaft extending along a longitudinal axis, a plurality of pumping stages, each stage having a diffuser mounted stationarily in the housing and an impeller having a hub through which the shaft extends for rotating the impeller, the pump having at least one module having a selected number of the stages and comprising in combination:

at least one stationary member on one of the diffusers, having an upward facing stationary bearing surface;

a runner having a bore which receives the shaft for rotation with the shaft and a lower surface which engages the stationary bearing surface; and a tension sleeve extending from the runner downward through the stages, the tension sleeve having a plurality of upward facing load shoulders spaced along its length, each of the upward facing load shoulders extending radially outward between two of the hubs and supporting one of the hubs against downthrust, whereby downthrust on each of the impellers transfers to the tension member and through the tension member to the runner and stationary bearing surface.

17. The pump according to claim 16 wherein the tension sleeve extends into the bore of the runner and has a downward facing shoulder which engages the runner.

18. The pump according to claim 16 further comprising:

an inner key located within a keyway formed on the shaft and within the tension sleeve; and an outer key located within a keyway formed on an exterior portion of the tension sleeve and within the hubs of the impellers.

19. The pump according to claim 16 wherein the upward facing shoulders comprise rings secured within circumferential grooves formed on an exterior portion of the tension sleeve.

20. In a centrifugal pump having a driven shaft extending along a longitudinal axis and a plurality of pumping stages, each stage having an impeller mounted to the shaft for rotation therewith and a stationary diffuser, the pump having at least one module containing a plurality of the stages and comprising in combination:

an upward facing stationary bearing surface supported by one of the diffusers of the module;

a runner which rotates with the shaft and has a downward facing bearing surface which engages the stationary bearing surface; and a load transfer member in engagement with the runner and having a plurality of upward facing load shoulders spaced along its length, each of the load shoulders supporting one of the impellers, whereby downthrust on each of the impellers transfers through one of the load shoulders to the load transfer member, and through the load transfer member to the runner and the stationary bearing surface.

21. The pump according to claim 20 wherein the load transfer member comprises a rod which locates within a groove formed on one side of the shaft.

22. The pump according to claim 20 wherein the load transfer member comprises a sleeve which locates within an annular space between the shaft and the runner, and between the shaft and the impellers.

23. The pump according to claim 20 wherein the upper end of the load transfer member has a downward facing shoulder which bears downward on the runner.

24. The pump according to claim 20 wherein the load shoulders extend radially outward from the load transfer member.

25. The pump according to claim 20, further comprising a clearance located between adjacent impellers within the module, the clearance allowing the impellers to move upward slightly relative to the shaft during upthrust.

26. The pump according to claim 20 wherein:

a key locates within a keyway formed between the impellers and the shaft and between the runner and the shaft to cause rotation of the impellers and the runner with the shaft; and the load transfer member comprises a rod which locates within a groove formed on a side of the shaft opposite the keyway.

27. The pump according to claim 20 wherein:

the stationary bearing surface is formed on a stationary member which has a cylindrical bore; and the runner has a cylindrical portion which is rotatably carried in the bore of the stationary member and an upper flange, the downward facing bearing surface of the runner being located on the flange.

28. In a centrifugal pump having a driven shaft extending along a longitudinal axis, a plurality of pumping stages, each stage having a stationary diffuser and a rotatable impeller, the improvement comprising in combination:

a counterbore formed in at least one of the diffusers;

a stationary thrust bearing mounted stationarily in the counterbore, the stationary thrust bearing having a bore and an upper bearing surface;

a runner having a cylindrical portion which is rotatably carried in the bore and a flange which has lower surface which engages the upper bearing surface of the stationary thrust bearing;

a plurality of keys located between the shaft and the runner and the shaft and the impellers for causing the runner and the impellers to rotate with the shaft but allowing axial movement relative to the shaft; and a load transfer member having a downward facing shoulder which engages the runner, the load transfer member extending through a selected number of the stages, the load transfer member having a plurality of upward facing load shoulders spaced along its length, each of the upward facing load shoulders extending radially outward between two of the impellers and supporting one of the impellers against thrust, whereby thrust on each of the impellers transfers to the load transfer member and through the load transfer member to the runner and thrust bearing.

29. The pump according to claim 28 wherein the load transfer member comprises a rod which locates within a groove formed on a side of the shaft.

30. The pump according to claim 28 wherein the load transfer member comprises a sleeve which surrounds the shaft and extends through the impellers of the selected number of stages.

31. In a centrifugal pump having a driven shaft extending along a longitudinal axis, a plurality of pumping stages, each stage having a diffuser mounted stationarily in the housing and a rotatable impeller through which the shaft extends, the pump having at least one thrust module having a selected number of the stages and comprising in combination:

at least one stationary thrust bearing mounted stationarily to one of the diffusers and having an upper bearing surface;

a runner having a bore which receives the shaft for rotation with the shaft and a lower surface which engages the upper bearing surface of the stationary thrust bearing;

a load transfer rod extending from the runner through the stages, the load transfer rod having a plurality of upward facing load shoulders spaced along its length, each of the upward facing load shoulders extending radially outward between two of the impellers and supporting one of the impellers against thrust, whereby thrust on each of the impellers transfers to the load transfer rod and through the load transfer rod to the runner and thrust bearing.

32. The pump according to claim 31, wherein the load transfer rod extends into the bore of the runner and has a downward facing shoulder that engages the runner.

33. The pump according to claim 31, wherein the load transfer rod is located within a longitudinal groove formed in the shaft.

34. The pump according to claim 31 further comprising:

a key positioned opposite the load transfer rod, the key being located in a longitudinal groove on one side of the shaft, in a mating longitudinal groove within the bore of the runner and within mating longitudinal grooves in the impellers for causing the runner and impellers to rotate with the shaft but allowing axial movement relative to the shaft.

35. In a centrifugal pump having a driven shaft extending along a longitudinal axis, a plurality of pumping stages, each stage having a stationary diffuser and a rotatable impeller mounted to the shaft for rotation therewith, the pump having at least one thrust module having a selected number of the stages and comprising in combination:

at least one stationary thrust bearing mounted stationarily to one of the diffusers and having an upper bearing surface;

a runner having a bore which receives the shaft for rotation with the shaft and a lower surface which engages the upper bearing surface of the stationary thrust bearing; and a load transfer sleeve extending from the runner through the stages, the load transfer sleeve having a plurality of upward facing load shoulders spaced along its length, each of the upward facing load shoulders extending radially outward between two of the impellers and supporting one of the impellers against thrust, whereby thrust on each of the impellers transfers to the load transfer sleeve and through the load transfer sleeve to the runner and thrust bearing.

36. The pump according to claim 35 wherein the load transfer sleeve extends into the bore of the runner and has a downward facing shoulder which engages the runner.

37. The pump according to claim 35 further comprising:

an inner key located within mating longitudinal grooves formed on the shaft and within the load transfer sleeve; and an outer key located within mating longitudinal grooves formed on an exterior portion of the load transfer sleeve and within the impellers.

38. The pump according to claim 35 wherein the upward facing shoulders comprise rings secured within circumferential grooves formed on an exterior portion of the sleeve.

* * * * *